United States Patent [19]

Horii

[11] 4,453,623

[45] Jun. 12, 1984

[54] BAG HAVING A COVER MEMBER FOR SHOES AND OTHER ITEMS

[75] Inventor: Takeshi Horii, Hirakata, Japan

[73] Assignee: Ace Company, Ltd., Osaka, Japan

[21] Appl. No.: 367,610

[22] Filed: Apr. 12, 1982

[30] Foreign Application Priority Data

Apr. 14, 1981 [JP] Japan ..... 56-54258[U]

[51] Int. Cl.[3] ..... A45G 3/12; A45G 13/02

[52] U.S. Cl. ..... 190/102; 190/109; 190/110

[58] Field of Search ..... 150/28 R, 34, 52 R; 190/41 C, 41 Z, 51, 52, 102, 109, 110

[56] References Cited

U.S. PATENT DOCUMENTS

| | | | |
|---|---|---|---|
| 624,981 | 5/1899 | Rosenblatt | 190/51 |
| 1,300,921 | 4/1919 | Briggs | 190/51 |
| 1,710,041 | 4/1929 | Brandt | 190/41 C |
| 1,760,098 | 5/1930 | Wilt | 190/41 Z |
| 1,908,178 | 5/1933 | Plotkin | 190/51 |
| 2,164,493 | 7/1939 | Branen | 190/52 |
| 2,481,565 | 9/1949 | Boretz | 190/51 |
| 2,571,892 | 10/1951 | Kath | 190/51 |
| 3,137,374 | 6/1964 | Holtzman | 190/51 |
| 3,175,658 | 3/1965 | Bierman | 190/51 X |
| 4,212,377 | 7/1980 | Weinreb | 190/52 |

FOREIGN PATENT DOCUMENTS

| | | | |
|---|---|---|---|
| 589279 | 5/1925 | France | 150/52 R |
| 2365308 | 5/1978 | France | 190/51 |
| 441860 | 1/1936 | United Kingdom | 150/34 |

*Primary Examiner*—William Price
*Assistant Examiner*—Sue A. Weaver
*Attorney, Agent, or Firm*—Wenderoth, Lind & Ponack

[57] ABSTRACT

A bag which has a cover member for shoes and other items. The cover member is placed on or fixed to the bottom part of the bag proper and comprises a bottom sheet and cover cloth which is of the same width as the bottom sheet and of the length long enough to cover shoes and other items. The cover cloth has fastening members to engage with corresponding fastening members provided at the bottom sheet, an other cover cloth and the inner side surface of the bag proper so as to ensure perfect covering.

2 Claims, 9 Drawing Figures

BAG HAVING A COVER MEMBER FOR SHOES AND OTHER ITEMS

BACKGROUND OF THE INVENTION

This invention relates to a bag provided with a cover member for shoes, soiled clothing or the like in which shoes for change, soiled clothing or the like can be kept separately from other goods in the bag.

It is is often the case with us that during a journey, we change shoes and have soiled clothing. Such shoes and soiled clothing are often put in a polyethylene bag, wrapper, or the like and kept in another bag, but when such a polyethylene bag or the like is not readily available, we are troubled with the storage of them. A special bag has been suggested for eliminating such trouble, namely, a bag which has a container formed in the lower half of the bag by providing a horizontal partition inside the bag and an opening which can be shut and opened made at one side of the bag corresponding to one side of the container, so that shoes or the like can be placed in or removed from the bag through the opening. Bags of this type, however, have disadvantages in that they are complicated in construction, take much time to be sewn together and have less holding capacity because they are divided into upper and lower parts.

An object of the present invention is to provide a bag which are low in cost, is simple in construction and has a cover member for shoes or other items which can be folded up or hooked to one inner side surface of the bag when it is not in use, thereby retaining the holding capacity of the bag.

The above-mentioned purpose can be achieved by the present invention. Several embodiments of the present invention are explained below in detail by referring to the accompanying drawings. Modifications regarding the details of construction are included in the scope of appended claim.

BRIEF DESCRIPTION OF THE DRAWINGS

FIG. 1(*b*) is a perspective view of the first embodiment, partly broken away, with a cover member enclosing shoes; FIG. 1(*c*) is a perspective view of the first embodiment, partly broken away, with a cover member in an L-shape; and (*d*) is a perspective view of the cover member itself;

DETAILED DESCRIPTION OF THE PREFERRED EMBODIMENTS

Embodiment 1

Figure 1A:
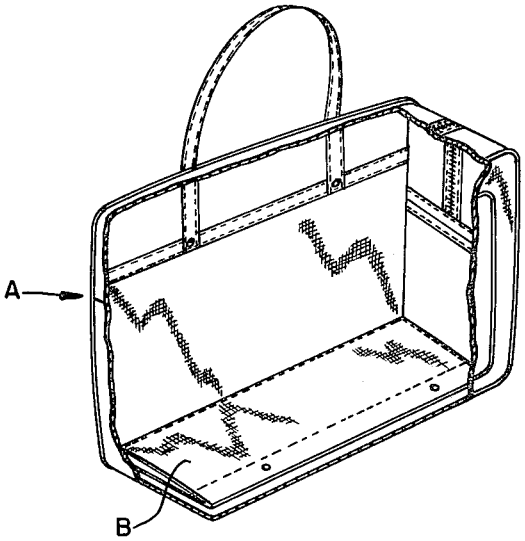
FIG. 1('a) is a perspective view of a first embodiment of the invention, partly broken away, with a cover member in a folded state.
Figure 1B:
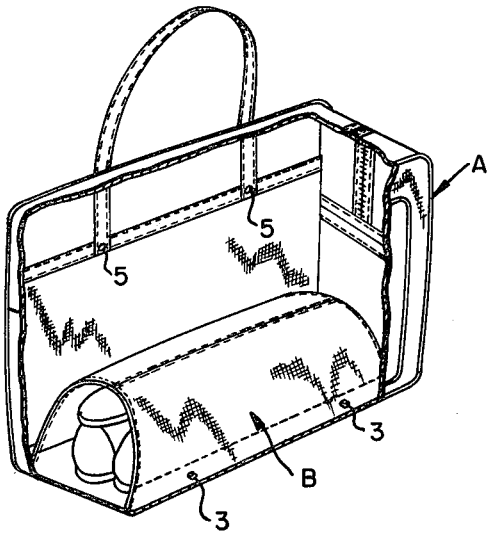
Figure 1C:
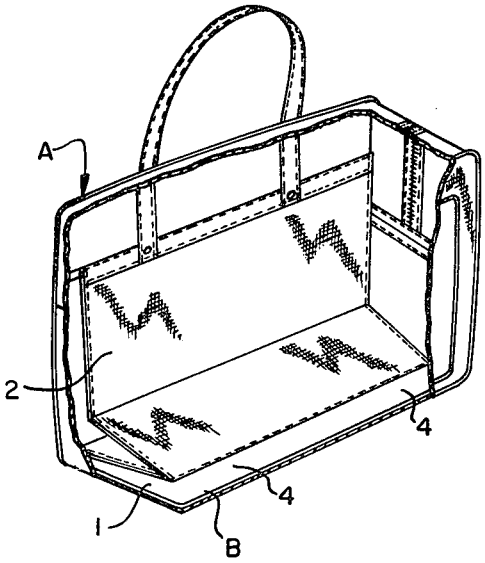
Figure 1D:
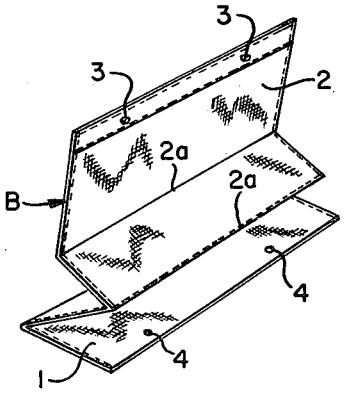

Referring to FIGS. 1(*a*)–1(*d*), there is shown a main body or bag proper A of a bag of the required size. A cover member B is provided at the inner bottom part of the bag proper A. This cover member B comprises a bottom sheet 1 and cover cloth 2. The bottom sheet 1 is of a size substantially the same as, or a little smaller than, the inner bottom part of the bag proper and is made of material having the required stiffness and covered with cloth over its entire surface.

Sewn to the edge of one of the lengthwise sides of this bottom sheet 1 is a lower end of the cover cloth 2, having the same width as the lengthwise side and a length long enough to cover shoes. Fastening members 3, 3 such as snap hooks, nylon magic tape or the like are provided at an upper end of the cover cloth 2 and corresponding fastening members 4, 4 are provided at an upper end of the other lengthwise side of the bottom sheet 1 so that both fastening members 3, 3 and 4, 4 are engaged with each other detachably.

Fastening members 5, 5, in order to engage with the fastening members 3, 3 detachably, are provided at an upper position of one of the inner lengthwise side walls of the bag proper A or at the ends of strips of the required length, so that the cover member B adopts an L-shape in cross section to form a pocket between the inner side surface of the bag proper and the cover cloth 2 (refer to FIG. 1(*c*)).

One fold or a plurality of folds 2*a*, 2*a* are made at the proper positions of the cover cloth 2 so that the cover cloth 2 can be folded up easily on the bottom sheet 1 when not in use.

The bottom sheet 1 is fixed to the bottom part of the bag proper at its lengthwise side having the fastening members 4,4 or is placed merely on the bottom part of the bag proper or is fixed detachably to the bottom part of the bag proper by means of snap hooks or any other means. If the bottom sheet 1 is provided in such a fashion that it is detachable from the bottom part of the bag proper, cover member B can be taken out for cleaning and washing. Even when the bottom sheet is fixed to the bottom part of the bag proper, if the cover cloth is fitted detachably to the bottom sheet, the cover cloth itself can be taken out for cleaning and washing.

According to the above-mentioned embodiment of the present invention, after shoes or other items are placed on the bottom sheet 1, they are covered with the cover cloth 2 and perfect covering is ensured by tightening fastening members 3, 3 and 4, 4. Therefore, other goods can be put on the cover cloth, free from touching directly with the shoes or other items (refer to FIG. 1(*b*)). While the cover member B is not in use, the cover cloth 2 can be folded up into a small volume as shown in FIG. 1(*a*) or the fastening members 3, 3 of the cover cloth are engaged, as shown by FIG. 1(*c*), with the fastening members 5, 5 provided at the inner side surface of the bag proper A so as to form an L-shaped pocket between the cover cloth and the inner side surface of the bag proper. This pocket can accommodate thin objects therein, without substantially reducing the holding capacity of the bag. If the cover cloth is made of a waterproof material, even when moistened objects are covered with the cover cloth, it will not have an unfavorable effect on other goods kept in the bag.

Embodiment 2

Figure 2A:
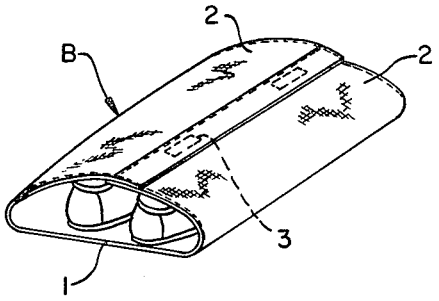
FIGS. 2(*a*) and 2(*b*) are perspective views of the cover member in accordance with a second embodiment of the invention.
Figure 2B:
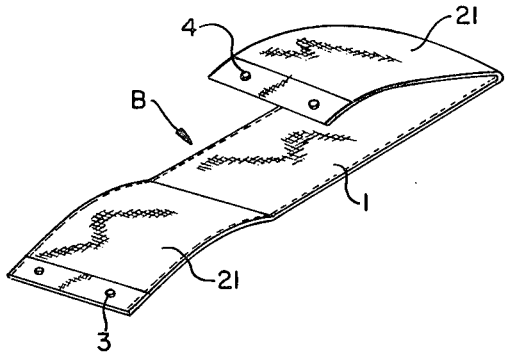

As shown by FIG. 2(*a*), this embodiment has a cover member B comprising a bottom sheet 1 which is substantially the same as the bottom sheet of Embodiment 1 and two cover cloths 2, 2, each having the length to overlap each other and being sewn to the edge of respective lengthwise side of the bottom sheet 1.

Similarly to the case of Embodiment 1, fastening members 3, 3 and 4, 4 are provided at the upper end of the cover cloth 2, 2. After shoes or other items placed on the bottom sheet 1 are covered with cover cloths 2, 2 in such a fashion that ends of the cover cloth overlap each other at the substantially central position of the bottom sheet 1, fastening members 3, 3 and 4, 4 are engaged with each other.

Although not shown in the drawings, fastening members which engage with the fastening members of the cover cloth are provided at a part of both inner side surfaces of the bag proper so as to form a pocket between the cover cloth and the inner side surface of the bag proper.

A cover member B can also be formed by sewing cover cloths 21, 21 to the edge of two shorter sides of the cover sheet 1, as shown by FIG. 2(*b*). In this case, fastening members are provided at the upper ends of the cover cloths 21, 21 and at the inner side surfaces of two shorter sides of the bag proper so that shoes or other items can be covered by overlapping two cover cloths and also pockets can be formed between the cover cloth and the inner side surfaces of two shorter sides of the bag proper.

Embodiment 3

Figure 3:
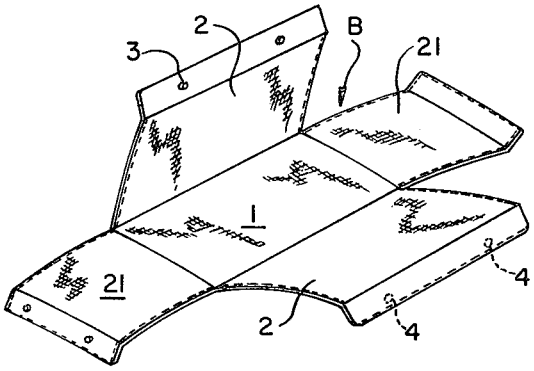
FIG. 3 is a perspective view of the cover member in accordance with a third embodiment of the invention.

As shown by FIG. 3, this embodiment has a cover member B comprising a bottom sheet 1 which is substantially the same as the bottom sheet of Embodiment 1 and four cover cloths 2, 2, 21, 21, each having the length long enough to overlap each other and being sewn to the edges of four sides of the bottom sheet 1. Fastening members are provided at the upper ends of the cover cloth 2, 2 or at the upper ends of the four cover cloths. In the case of this embodiment, shoes or other items can be covered perfectly by four cover cloths.

Embodiment 4

Figure 4:
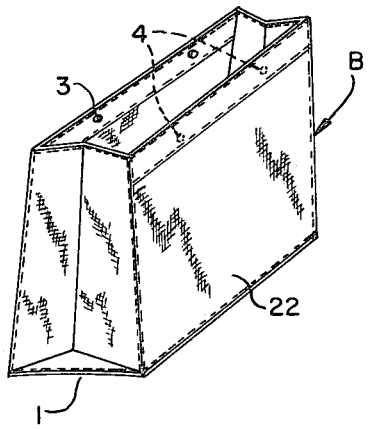
FIG. 4 and FIG. 5 respectively show perspective views of the cover member in accordance with a fourth embodiment.
Figure 5:
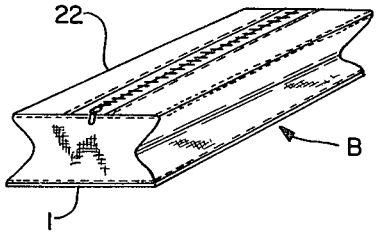

As shown by FIG. 4 and FIG. 5, this embodiment has a cover member B comprising a bottom sheet 1 which is substantially the same as the bottom sheet of Embodiment 1 and a cover cloth 22 in bag-shape which is sewn to the edges of the four sides of the bottom sheet 1 in such a fashion that an opening is made at the upper side. Snap hooks, nylon magic tape or the like are provided at the opening at the upper side of the cover cloth 22 or a zipper is provided at the opening of the cover cloth 22.

In this embodiment, shoes or other items can be enclosed in the cover cloth in bag-shape and such trouble that mud stuck to the soles of shoes comes off in the bag can be eliminated.

The bottom sheet in Embodiments 2, 3 and 4 is fixed to the inner bottom part of the bag proper A at two to four portions by bottom tacks or may be placed merely upon the inner bottom part of the bag proper. In the case where the bottom sheet is fixed to the bottom part of the bag proper, it is possible to make the cover cloth detachable from the bottom sheet by means of fastening members such as snap hooks, nylon magic tape or the like. Thus, if a cover member or a cover cloth is made removable, the cover member B or the cover cloth 2 can be taken out of the bag proper A for cleaning and washing. The cover member can be made of waterproofed material as in the case of Embodiment 1.

In the case where the cover member according to the present invention is applied to the bags whose bottom part has the required strength, such as roller Boston bags and suit cases, the cover cloth only may be sewn to or provided at the bottom part or side parts of the bag.

According to the present invention, shoes, soiled washing or others can be covered with a cover member and kept in the bag separately from other goods in the bag. When the cover member is not in use, it can be folded up into small bulk or a pocket can be formed between the cover cloth and the inner side surface of the bag proper, thereby retaining the holding capacity of the bag. Thus, the cover member according to the present invention is simple in construction and therefore cheap in cost and can be manufactured on mass production basis. Also, it can be applied to various kinds of bags.

What is claimed is:

1. A bag, comprising:

a main body, said main body including:

a bottom surface having opposing first long side edges and opposing first short side edges, opposing long side walls upstanding from said first long side edges and opposing short side walls upstanding from said first short side edges; one of said long side walls having first fastening members adjacent the top end thereof; and a cover member, said cover member including:

a stiff cloth-covered bottom sheet having opposing second long side edges and opposing second short side edges of dimensions to substantially cover said bottom surface, fixed to said bottom surface, said bottom sheet having second fastening members along one of said second long side edges, and a cover cloth having opposing side edges of length equal to the length of the second long side edges of said bottom sheet, one of the opposing side edges of said cover cloth being sewn to the other second long side edge of said bottom sheet and having a length between the opposing side edges thereof substantially greater than the second short side edges of the bottom sheet, said cover cloth having third fastening members at the other opposing side edge thereof, alternatively fastenable with said second fastening members for storing shoes or the like between said bottom sheet and said cover cloth, or with said first fastening members so that said cover member adopts a generally L-shaped configuration in cross section.

2. A bag as in claim 1, wherein said first, second and third fastening members comprise snap hooks.

* * * * *